US007235038B2

(12) United States Patent
Liao

(10) Patent No.: US 7,235,038 B2
(45) Date of Patent: Jun. 26, 2007

(54) ARM EXERCISER

(76) Inventor: Chung-San Liao, No. 133, Wucuo Li, Siluo Chen, Yunlin Hsien (TW)

( * ) Notice: Subject to any disclaimer, the term of this patent is extended or adjusted under 35 U.S.C. 154(b) by 0 days.

(21) Appl. No.: 11/264,045

(22) Filed: Nov. 2, 2005

(65) Prior Publication Data

US 2007/0099760 A1 May 3, 2007

(51) Int. Cl.
*A63B 23/14* (2006.01)
*A61F 5/00* (2006.01)

(52) U.S. Cl. ..... 482/44; 482/49; 602/16; 602/20

(58) Field of Classification Search ..... 482/44–46, 482/122, 124; 602/16, 20; 601/33
See application file for complete search history.

(56) References Cited

U.S. PATENT DOCUMENTS 3,698,389 A * 10/1972 Guedel ..... 602/20
5,100,126 A * 3/1992 Liou ..... 482/46
5,454,769 A * 10/1995 Chen ..... 482/46
5,662,594 A * 9/1997 Rosenblatt ..... 602/16
5,848,979 A * 12/1998 Bonutti et al. ..... 601/5
6,241,643 B1 * 6/2001 Loft et al. ..... 482/114
6,533,741 B1 * 3/2003 Lee et al. ..... 602/20
6,537,237 B1 * 3/2003 Hopkins et al. ..... 602/5
6,866,646 B2 * 3/2005 Hopkins et al. ..... 602/5

* cited by examiner

*Primary Examiner*—Stephen R. Crow
*Assistant Examiner*—Allana Lewin
(74) *Attorney, Agent, or Firm*—Bacon & Thomas, PLLC

(57) ABSTRACT

An arm exerciser includes a forearm section having a grip adjustably positioned in the forearm section via a securing device and an arm section pivotally connected to the forearm section. The arm section has two second pivot holes in alignment with the two first pivot holes of the forearm section so that each of the two pivot assemblies is able to extend through the aligned first pivot hole and the second pivot hole to allow the arm section to be pivotally connected to the forearm section and at least one second support formed on a bottom of the arm section so that two ends of at least one resilient element is able to be secured on the at least one first support and the at least one second support to provide resistance to the pivotal movement of the forearm section relative to the arm section.

4 Claims, 7 Drawing Sheets

ARM EXERCISER

BACKGROUND OF THE INVENTION

1. Field of the Invention

The present invention relates to an arm exerciser, and more particularly to an arm exerciser having an arm section and a forearm section pivotally connected to the arm section and having a grip securely yet rotatably received inside the forearm section so that the user is able to place his/her arm in the arm section and forearm in the forearm section and hold the grip to exercise his/her arm.

2. Description of Related Art

Normally, when a man wants to workout, he may go to the gymnasium or use the exercising apparatus purchased for designated purposes. However, going to and coming back from the gymnasium takes time and energy. Therefore, a lot of people choose to purchase the exercising apparatus and use them at homes. Still, despite the bulky dimension, shocking prices of the exercising apparatus often intimidate the shoppers for the exercising apparatus.

To overcome the shortcomings, the present invention tends to provide an improved arm exerciser to mitigate the aforementioned problems.

SUMMARY OF THE INVENTION

The primary objective of the present invention is to provide an improved arm exerciser which is small in size and simple in structure so that the user is able to easily applies the arm exerciser of the present invention at home.

In one aspect of the present invention, the arm exerciser of the present invention has an arm section and a forearm section pivotally connected to the arm section and having a grip securely yet rotatably received in the forearm section to allow the user to place his arm in the arm section and forearm in the forearm section and to hold the grip such that the user is able to exercise his arm.

In yet another aspect of the present invention, the forearm section has a U shaped cross section, a pair of elongated adjusting holes respectively defined in two opposed side walls thereof to allow extension of a securing device to secure a grip between the two opposed side walls and two first pivot holes defined in a free end thereof to allow extension of a pivot assembly. The arm section of the present invention has two second pivot holes defined to correspond to and align with the first pivot holes of the forearm section so that after the pivot assembly is extended through the aligned first pivot holes and the second pivot holes, the arm section and the forearm section is pivotally connected to each other.

A further aspect of the present invention is that at least one resilient element is provided between the arm section and the forearm section to provide resistance to the pivotal movement of the forearm section relative to the arm section. As a result of the resistance from the at least one resistance element, the user is able to exercise his arm.

Other objects, advantages and novel features of the invention will become more apparent from the following detailed description when taken in conjunction with the accompanying drawings.

DETAILED DESCRIPTION OF THE PREFERRED EMBODIMENT

Figure 1:
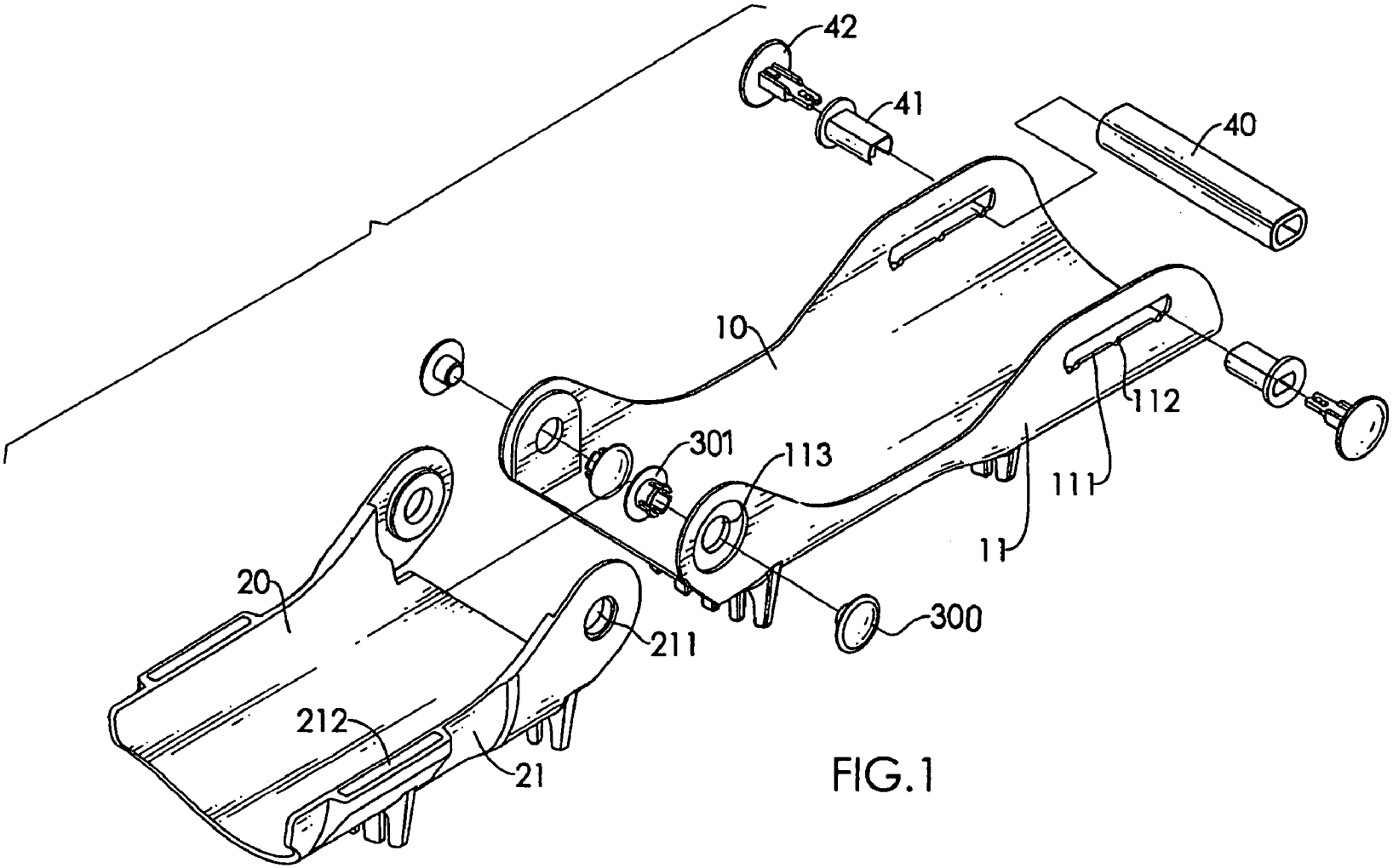
FIG. 1 is an exploded perspective view of the arm exerciser of the present invention.

With reference to FIG. 1, it is noted that the arm exerciser in accordance with the present invention includes a forearm section (10) and an arm section (20).

The forearm section (10) has a pair of elongated adjusting holes (111) respectively defined in two opposed side walls (11) thereof to allow extension of a securing device to secure a grip (40) between the two opposed side walls and two first pivot holes (113) defined in a free end thereof to allow extension of a pivot assembly (30). Each of the elongated adjusting holes (11) has multiple cutouts (112) defined in a bottom face defining the elongated adjusting hole (111) to communicate with the elongated adjusting hole (111). The arm section (20) of the present invention has two second pivot holes (211) defined in two opposed side walls (21) thereof to correspond to and align with the first pivot holes (113) of the forearm section (10) so that after the pivot assembly (30) is extended through the aligned first pivot holes (113) and the second pivot holes (211), the arm section (20) and the forearm section (10) is pivotally connected to each other. From the depiction of FIG. 1, it is noted that the pivot assembly (30) includes a head portion (300) and a body portion (301) detachably connected to the head portion (300). However, the structures of the head portion (300) and the body portion (301) vary differently such that any similar structure known in the art might be adopted and thus detailed description as to how the body portion (301) is inserted into and secured in the head portion (300) is omitted.

Figure 2:
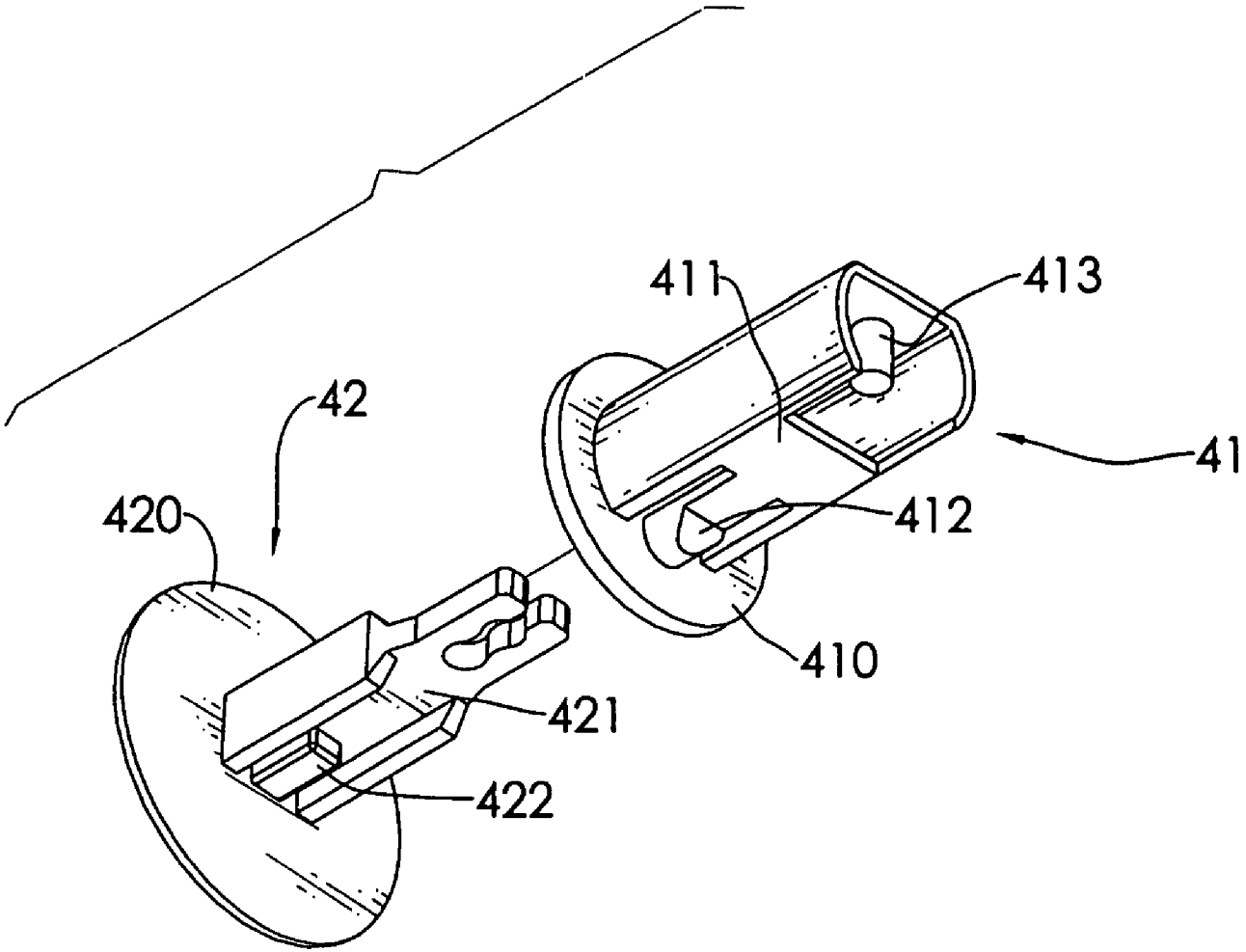
FIG. 2 is an exploded perspective view of the securing device of the present invention.

With reference to FIG. 2, the securing device in accordance with the present invention includes a locking element (41) and a controlling element (42). The locking element (41) is hollow inside and has two open ends. The locking element (41) includes an annular extension (411) extending from a side of a first disk (410) of the locking element (41), a locking boss (412) formed on a bottom face of the annular extension (411) to correspond to one of the cutouts (112) of the forearm section (10) and a locking rod (413) formed on a top inner side face of the locking element (41). The controlling element (42) includes a second disk (420), an extension (421) extending from a side face of the second disk (420) to be extended into one open end of the locking element (41), a controlling boss (422) formed on a bottom face of the extension (421) to correspond to and detachably connect to the locking boss (412) and a slit (423) defined in a free end of the controlling element (42) and having a cross section substantially the same as that of a digit "8" to correspond to and receive therein the locking rod (413).

Figure 4:
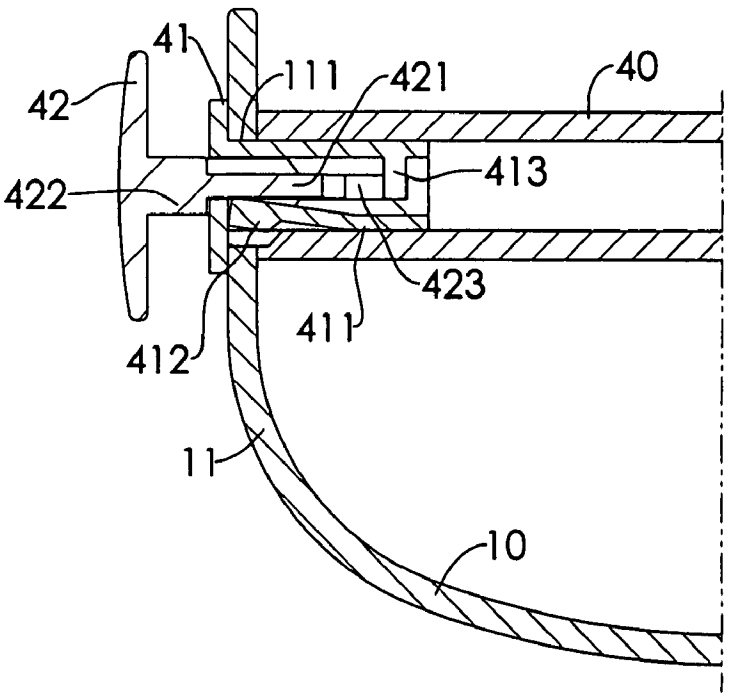
FIG. 4 is a schematic cross sectional view showing the adjustment of grip via releasing the securing device from the forearm section.
Figure 3:
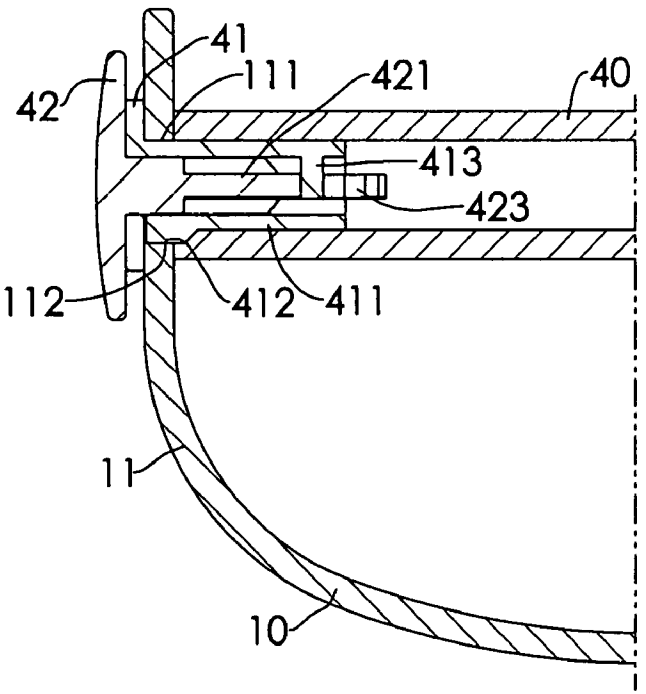
FIG. 3 is a schematic cross sectional view showing the extension of the securing device into the forearm section to secure the grip inside the forearm section.

With reference to FIGS. 3 and 4 and still using FIG. 1 for reference, it is noted that to secure the grip (40) which is hollow and having two open ends between the two opposed side walls (11) of the forearm section (10), the grip (40) is first placed between the two opposed side walls (11) to allow the two open ends of the grip (40) to align with the two elongated adjusting holes (111). Because the assembly of the securing device and the grip (40) in two opposed sides of the forearm section (10) is the same, the following description focuses only on one side of the assembly thereof. Then the locking element (41) is inserted through the elongated adjusting hole (111) and into one opening end of the grip (40). Thereafter, the controlling element (42) is inserted into one open end of the locking element (41) to allow the locking rod (413) to be received in the digit-8 shaped slit (423). While the locking rod (413) is received in the slit (423), the controlling boss (422) is on top of the locking boss (412) so that the locking boss (412) is forced by the controlling boss (422) to move downward and is received in a corresponding one of the cutouts (112), which secures the grip (40) between the two opposed walls (11) of the forearm section (10).

When adjusting position of the grip (40) is required to adjust length of the user's arm length, the user may pull out the controlling element (42) to release the pressure on the locking boss (412), so that the controlling element (42) as well as the locking element (41) is able to freely move inside the elongated adjusting hole (11) to meet the arm length adjustment requirement.

Figure 5:
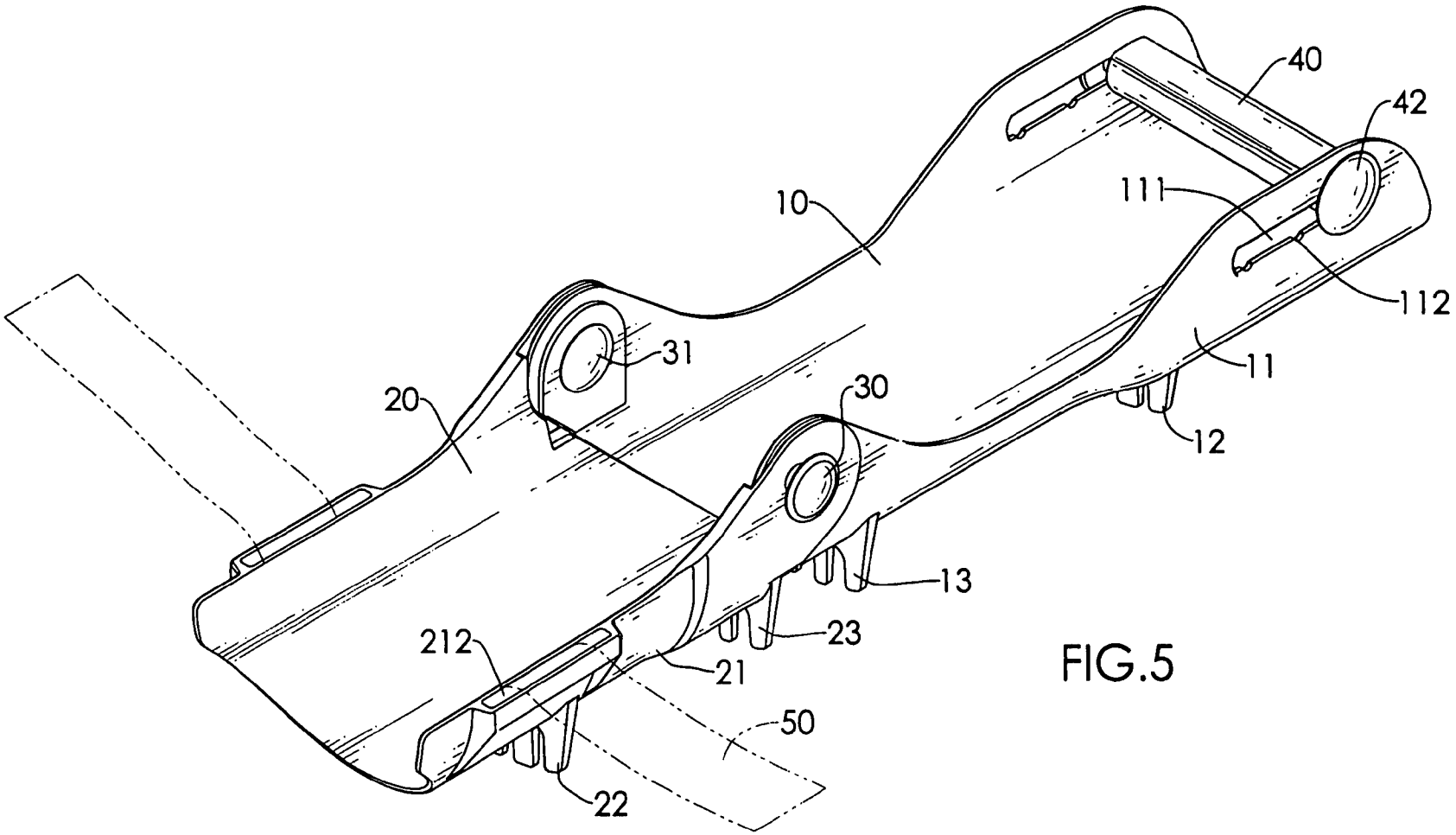
FIG. 5 is a perspective view showing the assembly of the arm exerciser of the present invention.

With reference to FIG. 5, the arm section (20) further has two securing holes (212) respectively defined in the two opposed side walls (21) to allow two straps (50) to be secured therein. Each strap (50) is provided with adhesive element such as VELCRO™, such that the user is able to use the two straps (50) to secure the arm in the arm section (20).

Figure 6:
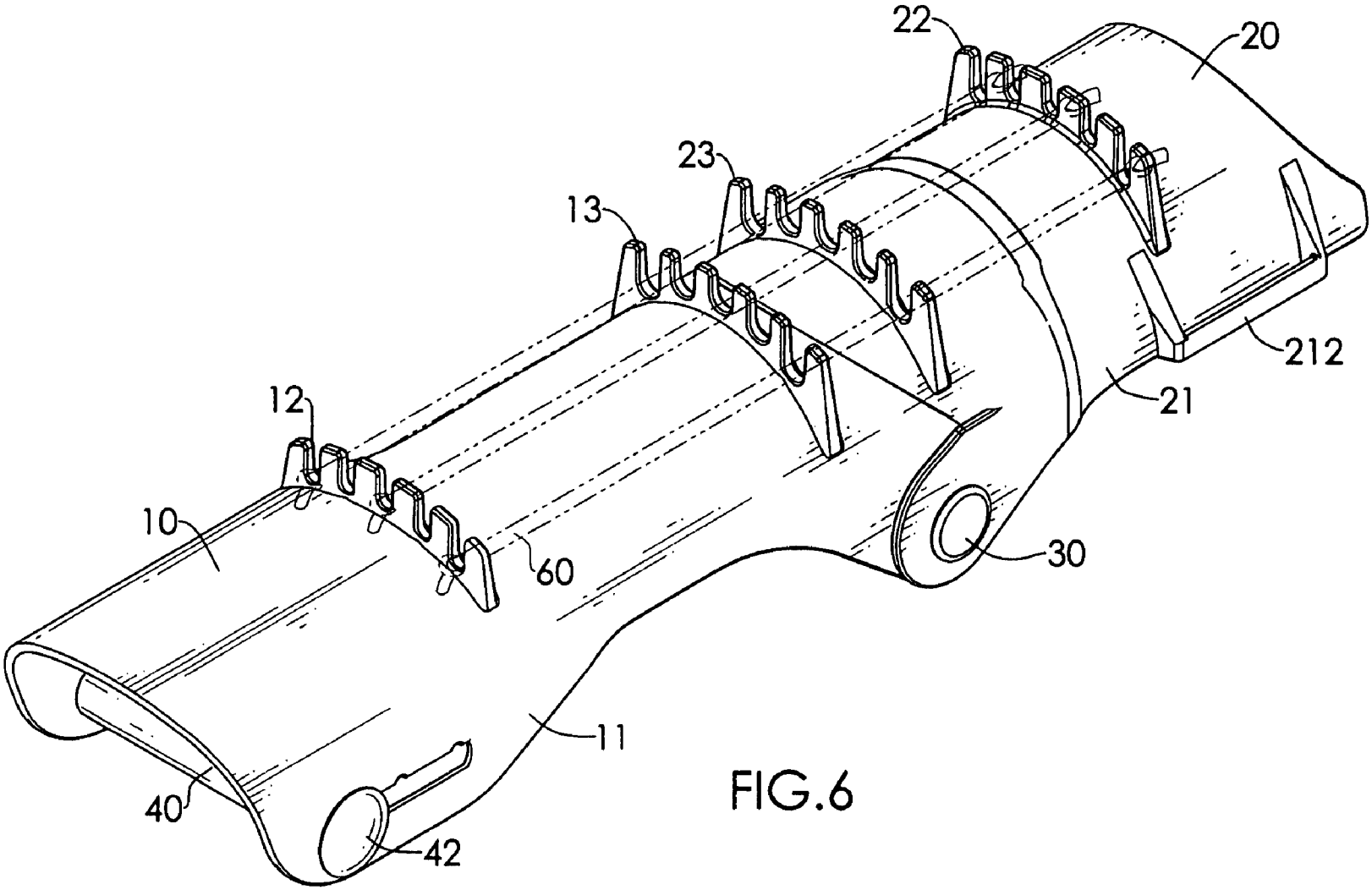
FIG. 6 is a perspective view showing at least one resilient element is provided to a bottom of the arm exerciser.

With reference to FIG. 6, it is noted that the forearm section (10) is provided with at least one first support (two supports (12,13) are provided in this embodiment) and the arm section (20) is provided with at least one second support (two supports (22,23) are provided in this embodiment) to respectively allow two ends of at least one resilient element (60) to be secured thereon so as to provide resistance to pivotal movement of the forearm section (10) relative to the arm section (20).

Figure 7:
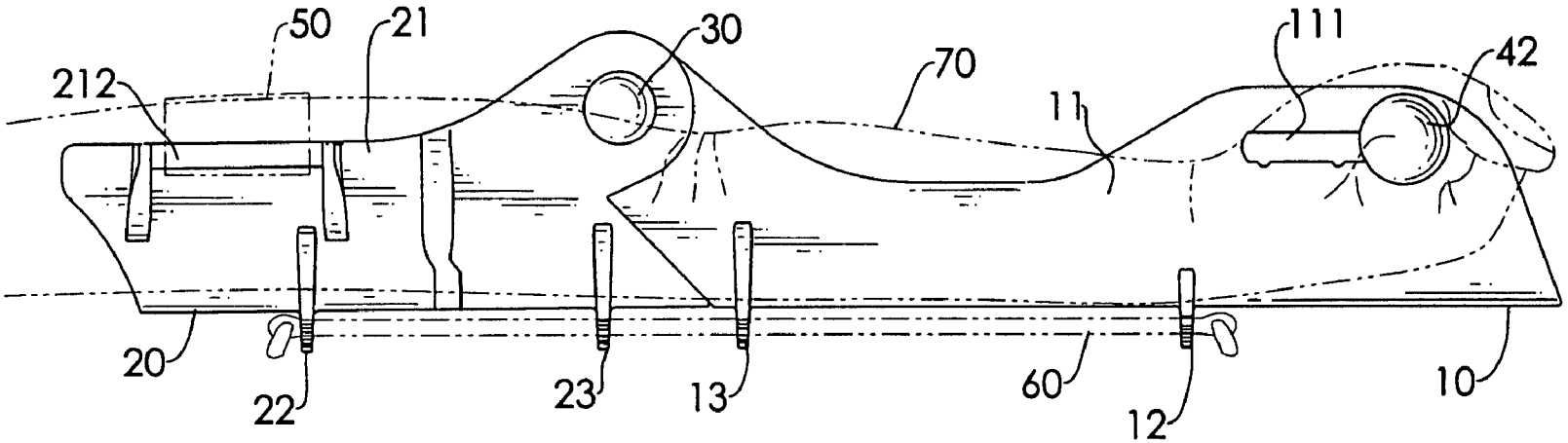
FIG. 7 is a schematic side plan view showing that the user is able to place his/her arm in the arm exerciser.
Figure 8:
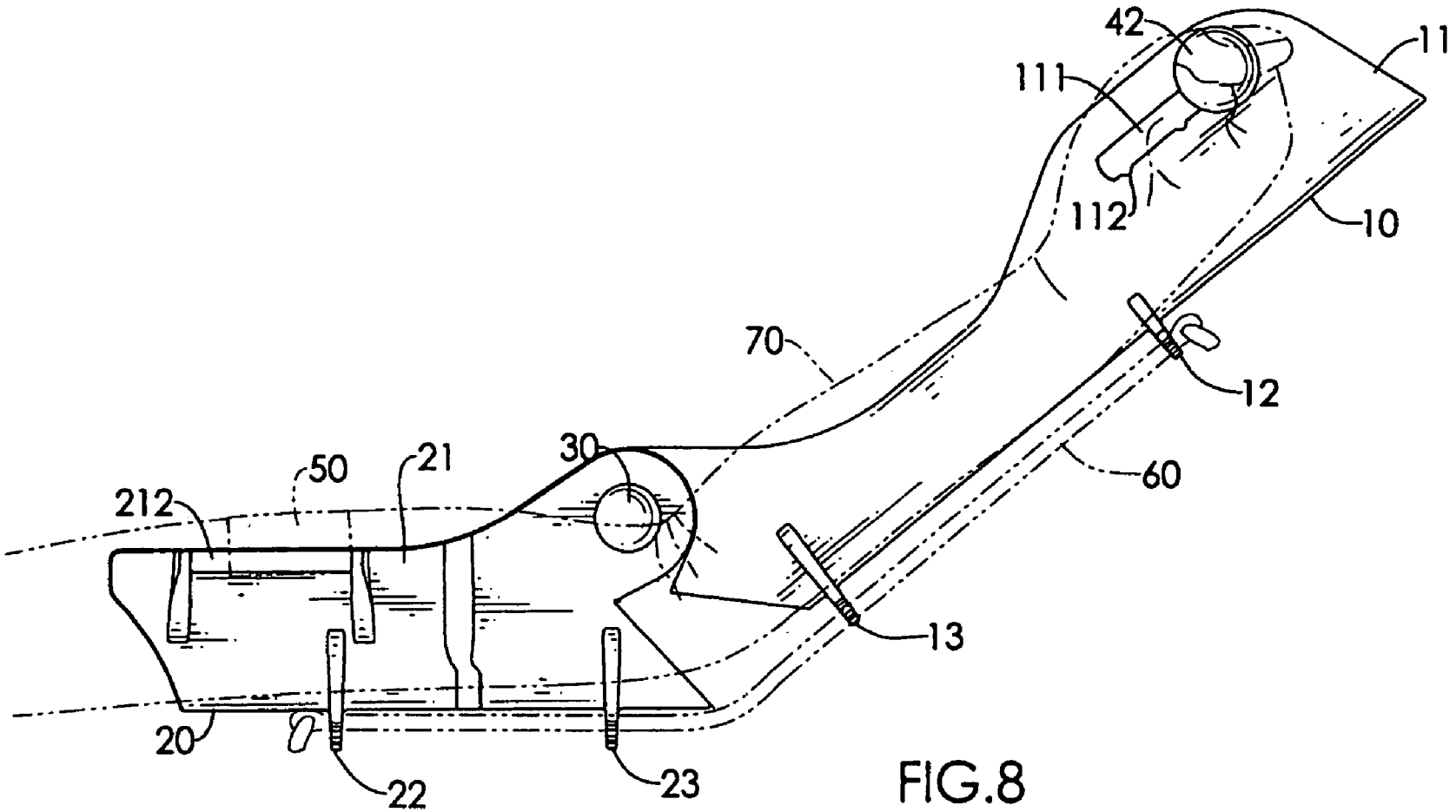
FIG. 8 is a schematic side plan view showing that the user is using the arm exerciser to workout the arm.

With reference to FIGS. 7 and 8, when the arm exerciser of the present invention is application, the user is able to place his/her arm in the arm section (20) and the forearm in the forearm section (10). After the arm is secured by the two straps (50), the user is able to hold the grip (40) and try to pivot the forearm section (10) relative to the arm section (20). Due to the resistance from the at least one resilient element (60), the goal of building the user's arm is accomplished.

Because the arm exerciser of the present invention is light weight and simple in structure, the price is inexpensive. Therefore, the utility thereof is beyond description.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An arm exerciser comprising:

a forearm section having a grip adjustably positioned in the forearm section via a securing device, two first pivot holes defined in two opposed side walls thereof to allow extension of two pivot assemblies and at least one first support formed on a bottom of the forearm section; and an arm section pivotally connected to the forearm section and having two second pivot holes in alignment with the two first pivot holes so that each of the two pivot assemblies is able to extend through the aligned first pivot hole and the second pivot hole to allow the arm section to be pivotally connected to the forearm section and at least one second support formed on a bottom of the arm section so that two ends of at least one resilient element is able to be secured on the at least one first support and the at least one second support to provide resistance to the pivotal movement of the forearm section relative to the arm section, wherein the forearm section further has two elongated adjusting holes respectively defined in two opposed side walls of the forearm section and the grip is adjustably positioned between the two opposed side walls, the securing device extends through each of the elongated adjusting holes and into each of two open ends of the grip to position the grip between the two opposed side walls of the forearm section, the securing device includes two locking elements and two controlling elements each detachably connected to a corresponding one of the locking elements, each locking element is hollow and has two open ends, the locking element includes a first disk, an annular extension extending out from a side face of the first disk to be extended into a corresponding one of the two elongated adjusting holes and one of the two open ends of the grip, a locking boss formed on a bottom face of the annular extension to be movable relative to the first disk and a locking rod formed on an inner face of the annular extension, each controlling element includes a second disk, an extension extending from a side face of the second disk and into one open end of the locking element, a controlling boss formed on a bottom face of the extension to be on top of the locking boss after the extension is extended into the open end of the locking element and a slit defined in a free end of the controlling element to detachably receive therein the locking rod such that after the locking boss is forced by the controlling boss to move, the grip is secured.

2. The arm exerciser as claimed in claim 1, wherein the forearm section further has multiple cutouts defined in an inner face defining the elongated adjusting hole to receive therein the locking boss after the locking boss is forced by the controlling boss.

3. The arm exerciser as claimed in claim 1, wherein the arm section further has two securing holes respectively defined in the two opposed side walls to allow two straps to be secured therein for securing an arm in the arm section.

4. The arm exerciser as claimed in claim 2, wherein the arm section further has two securing holes respectively defined in the two opposed side walls to allow two straps to be secured therein for securing an arm in the arm section.

* * * * *